US009133844B2

(12) United States Patent
Murakami et al.

(10) Patent No.: US 9,133,844 B2
(45) Date of Patent: Sep. 15, 2015

(54) SCROLL MEMBER, METHOD OF MANUFACTURING SAME, COMPRESSION MECHANISM AND SCROLL COMPRESSOR

(75) Inventors: Yasuhiro Murakami, Sakai (JP); Mikio Kajiwara, Sakai (JP); Mitsuhiko Kishikawa, Sakai (JP); Hiroyuki Yamaji, Sakai (JP); Mie Arai, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 837 days.

(21) Appl. No.: 12/531,913

(22) PCT Filed: Mar. 27, 2008

(86) PCT No.: PCT/JP2008/055819

§ 371 (c)(1), (2), (4) Date: Sep. 18, 2009

(87) PCT Pub. No.: WO2008/120651

PCT Pub. Date: Oct. 9, 2008

(65) Prior Publication Data

US 2010/0111738 A1 May 6, 2010

(30) Foreign Application Priority Data

Mar. 30, 2007 (JP) ..... 2007-092274

(51) Int. Cl.
*F04C 18/02* (2006.01)

(52) U.S. Cl.
CPC ..... *F04C 18/0215* (2013.01); *F04C 18/0269* (2013.01); *F04C 18/0246* (2013.01); *F04C 2230/10* (2013.01); *F04C 2230/21* (2013.01)

(58) Field of Classification Search
CPC ..... B23P 15/00; B23P 13/00; B23P 13/04; F04C 2230/00; F04C 2230/10; F04C 2230/21
USPC ..... 29/888.02, 888.022, 888.023, 888.025, 29/889, 889.4, 889.5, 889.6
See application file for complete search history.

(56) References Cited

U.S. PATENT DOCUMENTS

| | | | | |
|---|---|---|---|---|
| 4,522,574 | A * | 6/1985 | Arai et al. | 418/55.1 |
| 5,125,810 | A * | 6/1992 | Suefuji et al. | 418/55.2 |
| 5,388,973 | A | 2/1995 | Richardson, Jr. | |
| 5,554,017 | A * | 9/1996 | Kohsokabe et al. | 418/55.2 |

(Continued)

FOREIGN PATENT DOCUMENTS

| | | |
|---|---|---|
| EP | 0 059 612 A2 | 9/1982 |
| EP | 1 225 338 A2 | 7/2002 |

(Continued)

OTHER PUBLICATIONS

European Search Report of corresponding EP Application No. 08 73 8969.8 dated Dec. 4, 2014.

*Primary Examiner* — Christopher Besler
(74) *Attorney, Agent, or Firm* — Global IP Counselors

(57) ABSTRACT

A method of manufacturing a scroll member for a compression mechanism installed in a scroll compressor includes a casting step and a cutting step. An iron casting is formed in the casting step, which includes a spiraling part. The iron casting obtained in the casting step is cut during the cutting step in order to obtain a final shape of the scroll member. The iron casting may include a fixed part having a central portion with a first axial thickness and an external periphery portion with a second axial thickness larger than the first axial thickness before the cutting step. A dimension of a specified portion of the spiraling part may be larger before the cutting step is performed than after the cutting step is performed, with the specified portion preferably disposed toward an external periphery of the spiraling part.

12 Claims, 8 Drawing Sheets

(56) References Cited

U.S. PATENT DOCUMENTS

| | | | | |
|---|---|---|---|---|
| 5,730,588 | A | 3/1998 | Terai et al. | |
| 6,048,142 | A * | 4/2000 | Hashimoto et al. | 29/888.022 |
| 6,086,341 | A * | 7/2000 | Fukuhara et al. | 418/55.2 |
| 2002/0098100 | A1 * | 7/2002 | Mori et al. | 418/55.2 |
| 2003/0019603 | A1 | 1/2003 | Williamson | |
| 2005/0053507 | A1 * | 3/2005 | Takeuchi et al. | 418/55.1 |
| 2006/0159580 | A1 * | 7/2006 | Matsuhashi | 418/55.2 |

FOREIGN PATENT DOCUMENTS

| | | | |
|---|---|---|---|
| JP | 09-004576 | A | 1/1997 |
| JP | 10-082381 | A | 3/1998 |
| JP | 2002-070767 | A | 3/2002 |
| JP | 2002-312420 | A | 10/2002 |
| JP | 2003-336585 | A | 11/2003 |
| JP | 2005-036693 | A | 2/2005 |
| WO | 89/08522 | A | 9/1989 |

* cited by examiner

SCROLL MEMBER, METHOD OF MANUFACTURING SAME, COMPRESSION MECHANISM AND SCROLL COMPRESSOR

CROSS-REFERENCE TO RELATED APPLICATIONS

This U.S. National stage application claims priority under 35 U.S.C. §119(a) to Japanese Patent Application No. 2007-092274, filed in Japan on Mar. 30, 2007, the entire contents of which are hereby incorporated herein by reference.

TECHNICAL FIELD

The present invention relates to a scroll member and a method for manufacturing the same.

BACKGROUND ART

A scroll-type compressor comprises a compression mechanism for compressing a refrigerant. The compression mechanism has a fixed scroll and an orbiting scroll.

Methods for forming cast iron by using a metal die, for example, have been used conventionally as methods for manufacturing fixed scrolls, orbiting scrolls, and other scroll members. In conventional methods, cast iron has been formed into substantially the same shape of the finished products of scroll members (see Japanese Laid-open Patent Application No. 2005-36693, for example).

The art pertaining to the present invention is shown hereinbelow.

SUMMARY OF THE INVENTION

Technical Problem

However, if cast iron is formed into the same shape of the finished products of the scroll members, the portion extending in a spiraling formation of low thickness is susceptible to cooling due to a low heat capacity, and the hardness cannot be increased. Therefore, when the compression mechanism is driven, there is a danger that this portion will suffer wear or deformation.

The strength of this portion can be increased by increasing the thickness of this portion, but this is undesirable because the size of the compression mechanism is increased.

The present invention was made in view of the circumstances described above, and an object thereof is to reduce wear and deformation in a scroll member.

Solution to Problem

A method for manufacturing a scroll member according to a first aspect of the invention is a method for manufacturing a scroll member used in a compression mechanism installed in a scroll compressor, the method comprising a step (a) and a step (b). In step (a), cast iron is formed and an iron casting is obtained, the iron casting having a spiraling part extending in a spiraling formation and a fixed part for fixing the spiraling part. In step (b), the iron casting obtained in step (a) is cut and the scroll member is obtained. The fixed part of the iron casting obtained in step (a) has a greater thickness in a portion near the external periphery than the thickness of a portion near the center of the spiral.

A method for manufacturing a scroll member according to a second aspect of the invention is the method for manufacturing a scroll member according to the first aspect of the invention, wherein the iron casting obtained in step (a) also has a protruding part. The protruding part is fixed to the fixed part on the side opposite the spiraling part and is given an annular shape encircling the center. The portion near the external periphery is positioned on the external side of the protruding part when the iron casting is viewed from the side having the spiraling part.

A method for manufacturing a scroll member according to a third aspect of the invention is a method for manufacturing a scroll member used in a compression mechanism installed in a scroll compressor, the method comprising a step (a) and a step (b). In step (a), cast iron is formed and an iron casting is obtained, the iron casting having a spiraling part extending in a spiraling formation. In step (b), the iron casting obtained in step (a) is cut and the scroll member is obtained. In the iron casting obtained in step (a), a dimension of a specified portion of the spiraling part is greater than a dimension of the same portion after step (b) is performed. The specified portion extends along the spiral from an end on the external periphery of the spiral to a position different from an end at the center of the spiral.

A method for manufacturing a scroll member according to a fourth aspect of the invention is the method for manufacturing a scroll member according to the third aspect of the invention, wherein the iron casting obtained in step (a) also has a fixed part for fixing the spiraling part, and a protruding part. The protruding part is fixed to the fixed part on the side opposite the spiraling part and is positioned near the center. The specified portion is positioned farther peripherally outward than a side surface of the protruding part when the iron casting is viewed from the side having the spiraling part.

A method for manufacturing a scroll member according to a fifth aspect of the invention is the method for manufacturing a scroll member according to the fourth aspect of the invention, wherein the dimension of the specified portion is greater than the dimension of a portion of the spiraling part located farther peripherally inward than the side surface.

A method for manufacturing a scroll member according to a sixth aspect of the invention is the method for manufacturing a scroll member according to any of the third through fifth aspects of the invention, wherein the specified portion extends around the center to a position located anywhere from a half circle up to a full circle from the end.

A method for manufacturing a scroll member according to a seventh aspect of the invention is the method for manufacturing a scroll member according to a sixth aspect of the invention, wherein the specified portion is cut in step (b) only at the portion on the external periphery.

A method for manufacturing a scroll member according to an eighth aspect of the invention is the method for manufacturing a scroll member according to any of the third through seventh aspects of the invention, wherein the dimension is the thickness of the spiraling part.

A method for manufacturing a scroll member according to a ninth aspect of the invention is the method for manufacturing a scroll member according to the eighth aspect of the invention, wherein the iron casting obtained in step (a) also has a fixed part for fixing the spiraling part. The height of the specified portion from the fixed part is greater than the same height after step (b) is performed.

A method for manufacturing a scroll member according to a tenth aspect of the invention is the method for manufacturing a scroll member according to any of the third through seventh aspects of the invention, wherein the iron casting obtained in step (a) also has a fixed part for fixing the spiraling part. The dimension is the height of the spiraling part from the fixed part.

A method for manufacturing a scroll member according to an eleventh aspect of the invention is the method for manufacturing a scroll member according to any of the third through tenth aspects of the invention, wherein the dimension of the specified portion decreases progressively going from the end on the external periphery toward the end at the center.

A method for manufacturing a scroll member according to a twelfth aspect of the invention is the method for manufacturing a scroll member according to any of the first through eleventh aspects of the invention, wherein the iron casting is formed by semi-molten die casting in step (a).

A scroll member according to a thirteenth aspect of the invention is a scroll member manufactured by the method according to any of the first through twelfth aspects of the invention. After step (b) is performed, the ratio of the height of the spiraling part from the fixed part to the thickness of the spiraling part is 8.5 or greater.

A compression mechanism according to a fourteenth aspect of the invention comprises the scroll member according to the thirteenth aspect of the invention as an orbiting scroll or a fixed scroll, or both.

A scroll compressor according to a fifteenth aspect of the invention comprises the compression mechanism according to the fourteenth aspect of the invention.

A scroll compressor according to a sixteenth aspect of the invention is the scroll compressor according to the fifteenth aspect of the invention for compressing a refrigerant including carbon dioxide as a main component.

Advantageous Effects of the Invention

With the method for manufacturing a scroll member according to the first aspect, since the fixed part in step (a) has a greater thickness in a portion near the external periphery than the thickness of a portion near the center, the portion near the external periphery has a greater heat capacity than the portion near the center. Consequently, the portion near the external periphery is more resistant to cooling than the portion near the center even after being formed, and even in the spiraling part, the portion near the external periphery is resistant to cooling. This allows the hardness of the portion near the external periphery to be increased in the spiraling part, and the difference in hardness from the portion near the center to be reduced.

With the method for manufacturing a scroll member according to the second aspect, the hardness of the portion at the external periphery in the spiraling part can be made greater than that of the protruding part.

With the method for manufacturing a scroll member according to the third aspect, the dimension of the portion near the end at the external periphery of the spiral is increased in step (a) to be greater than the same dimension after step (b) is performed, whereby the heat capacity of this portion is increased. Consequently, this portion is resistant to cooling even after being formed. The hardness of this portion can thereby be increased, and wear in the scroll member can also be reduced.

With the method for manufacturing a scroll member according to the fourth aspect, in the spiraling part, the hardness of the portion at the external periphery can be increased to be greater than that of the side surface of the protruding part. Consequently, in the spiraling part, it is possible to reduce the difference in hardness between the portion positioned on the internal side of the side surface of the protruding part and the portion positioned on the external side.

With the method for manufacturing a scroll member according to the fifth aspect, in the spiraling part, it is possible to reduce the difference in hardness between the portion positioned on the internal side of the side surface of the protruding part and the portion positioned on the external side.

With the method for manufacturing a scroll member according to the sixth aspect, it is possible to increase the hardness of the portion positioned in the external periphery of the spiral.

With the method for manufacturing a scroll member according to the seventh aspect, since the specified portion is positioned in the external periphery of the spiral, this portion is cut more readily at an external peripheral portion thereof.

With the method for manufacturing a scroll member according to the eighth aspect, the hardness of the spiraling part can be increased.

With the method for manufacturing a scroll member according to the ninth or tenth aspect, it is possible to increase the hardness of the portion at the distal end of the spiraling part when the spiraling part is viewed from the fixed part.

With the method for manufacturing a scroll member according to the eleventh aspect, variations in hardness in the specified portion can be reduced.

With the method for manufacturing a scroll member according to the twelfth aspect, the strength of the resulting scroll member can be increased by using semi-molten die casting. With the scroll member according to the thirteenth aspect, since the scroll member is manufactured by the method of any of claims 1 through 10, the spiraling part has high strength, and is resistant to deformation even if the ratio of height to thickness is 8.5 or greater. Consequently, the scroll member can be reduced in size.

With the compression mechanism according to the fourteenth aspect, since strength is high in the portion near the end at the external periphery of the spiraling part, the scroll member is resistant to deformation. Consequently, the compression mechanism does not readily break down.

With the scroll compressor according to the fifteenth aspect, since the compression mechanism does not readily break down, the scroll compressor also does not readily break down.

With the scroll compressor according to the sixteenth aspect, the scroll compressor does not readily break down even if carbon dioxide is used, because the compression mechanism has high strength.

DETAILED DESCRIPTION OF THE INVENTION

Figure 1:
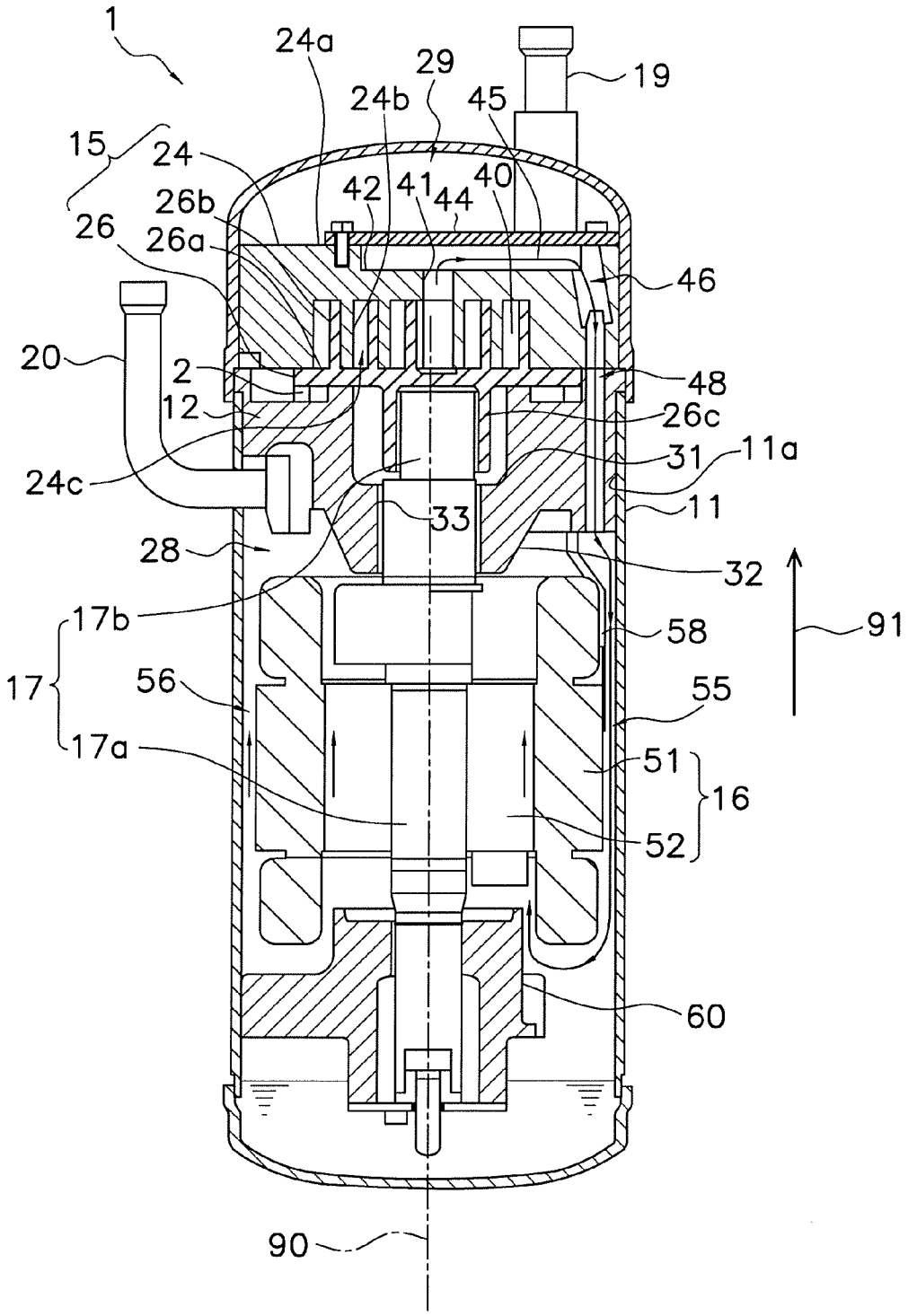
FIG. 1 is a drawing schematically depicting a scroll compressor 1 according to an embodiment of the present invention.

FIG. 1 is a drawing schematically depicting a scroll compressor 1 according to an embodiment of the present invention. The direction 91 is shown in FIG. 1, and hereinbelow the distal side of the arrow of the direction 91 is referred to as "up," while the opposite side is referred to as "down."

The scroll compressor 1 comprises a case 11 and a compression mechanism 15. The case 11 has a cylindrical shape and extends along the direction 91. The compression mechanism 15 is housed within the case 11.

The compression mechanism 15 has a fixed scroll 24 and an orbiting scroll 26 and compresses refrigerant. A substance containing, e.g., carbon dioxide as a primary component can be used as the refrigerant. The fixed scroll 24 and the orbiting scroll 26 can both be understood as the scroll member used in the compression mechanism 15.

The fixed scroll 24 includes a panel 24*a* and a compression member 24*b*. The panel 24*a* is fixed to an internal wall 11*a* of the case 11, and the compression member 24*b* is linked to the underside of the panel 24*a*. The compression member 24*b* extends in a spiraling formation, and a groove 24*c* is formed inside the spiral. A hole 41 is formed in the central vicinity of the panel 24*a*. Refrigerant compressed by the compression mechanism 15 is discharged through the hole 41.

The orbiting scroll 26 has a panel 26*a* and a compression member 26*b*. The compression member 26*b* is linked to the top side of the panel 26*a* and is made to extend in a spiraling formation.

The compression member 26*b* is accommodated within the groove 24*c* of the fixed scroll 24. A space 40 between the compression member 24*b* and the compression member 26*b* is hermetically sealed by the panels 24*a*, 26*a* and is thereby used as a compression chamber.

In relation to the method for manufacturing a scroll member, the method for manufacturing the orbiting scroll 26 is described hereinbelow in the first and second embodiments, and the method for manufacturing the fixed scroll 24 is described in the third embodiment. In the fourth embodiment, the scroll members obtained by the pertinent manufacturing methods are described.

First Embodiment

The method for manufacturing the orbiting scroll 26, which is a scroll member, comprises a step (a) and a step (b).

In step (a), cast iron is formed and an iron casting is obtained. For example, an iron casting of high strength can be obtained by forming cast iron by semi-molten die casting. In step (b), the iron casting obtained in step (a) is cut to obtain the orbiting scroll 26.

Figure 2:
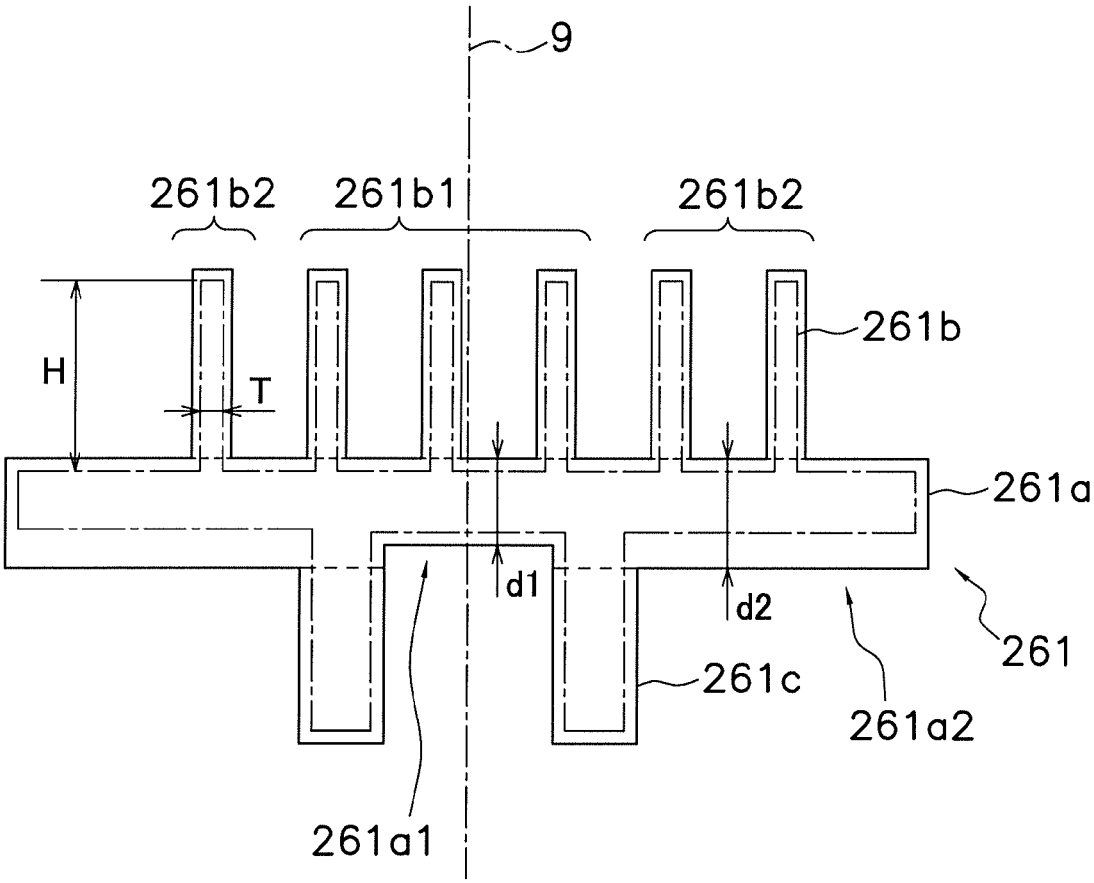
FIG. 2 pertains to an orbiting scroll and schematically depicts an iron casting 261 obtained in step (a).
Figure 3:
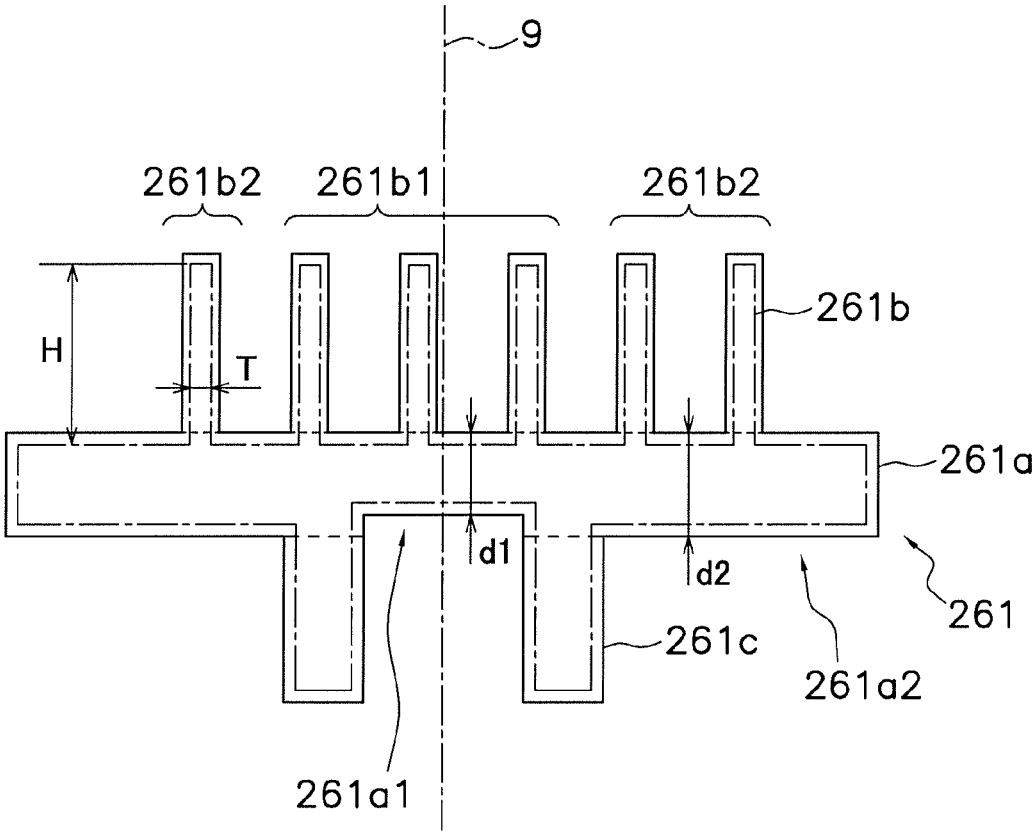
FIG. 3 pertains to an orbiting scroll and schematically depicts an iron casting 261 obtained in step (a).

FIGS. 2 and 3 schematically depict an iron casting 261 obtained in step (a). The iron casting 261 has a fixed part 261*a* and a spiraling part 261*b*. The spiraling part 261*b* is fixed to the fixed part 261*a* and is made to extend in a spiraling formation around a center 9. In FIGS. 2 and 3, the shape of the iron casting 261 obtained after step (b) is performed; i.e., the shape of the orbiting scroll 26 is shown by single-dashed lines.

In the fixed part 261*a* in FIGS. 2 and 3, the thickness d2 of the portion 261*a*2 near the external periphery is greater than the thickness d1 of the portion 261*a*1 near the center 9.

By performing step (b) on the iron casting 261 obtained in step (a), the panel 26*a* is obtained from the fixed part 261*a*, and the compression member 26*b* is obtained from the spiraling part 261*b*.

By performing step (b), e.g., the thickness of the panel 26*a* may be made either the same as that of the portion 261*a*1 in the portion 261*a*2 (FIG. 2), or greater than that of the portion 261*a*1 in the portion 261*a*2 (FIG. 3).

According to the method for manufacturing this orbiting scroll 26, the portion 261*a*2 near the external periphery has a greater thickness than the portion 261*a*1 near the center 9, and therefore has a greater heat capacity. Consequently, the portion 261*a*2 resists cooling better than the portion 261*a*1 even after being formed, and the spiraling part 261*b* also resists cooling better in the portion 261*b*2 near the external periphery. The hardness of the portion 261*b*2 in the spiraling part 261*b* can thereby be increased.

In FIGS. 2 and 3, the iron casting 261 also has a protruding part 261*c*. The protruding part 261*c* is fixed to the fixed part 261*a* from the side opposite the spiraling part 261*b*, and is formed into an annular shape encircling the center 9.

When the iron casting 261 is viewed from the side having the spiraling part 261*b*, the portion 261*a*2 near the external periphery is positioned on the external side of the protruding part 261*c*.

With this iron casting 261, since the protruding part 261*c* is near the center 9, the iron casting 261 has increased heat capacity in the portion near the center 9, and this portion is resistant to cooling even after being formed. Consequently, the portion 261*b*1 near the center 9 in the spiraling part 261*b* is resistant to cooling, and the hardness of the portion 261*b*1 is also increased.

Moreover, in the spiraling part 261*b*, the hardness of the portion 261*b*2 on the external side of the protruding part 261*c* can also be increased. Consequently, the difference in hardness between the portion 261*b*2 and the portion 261*b*1 is small, and variations in hardness in the iron casting 261 are small as well.

The protruding part 261*c* machined in step (b) is used in the orbiting scroll 26 as a bearing 26*c* (FIG. 1), described hereinafter.

Second Embodiment

The present embodiment also relates to a method for manufacturing an orbiting scroll 26, which is a scroll member. This manufacturing method comprises the same step (a) and step (b) as the first embodiment. However, the shape of the iron casting 261 obtained from step (a) differs from that of the first embodiment. The shape of the pertinent iron casting 261 is described hereinbelow using FIGS. 4 through 7. In FIGS. 4 through 7, the shape of the iron casting 261 obtained by performing step (b) is shown by single-dashed lines.

In the iron casting 261 obtained in step (a), the dimensions of specified portions of the spiraling part 261*b* are greater than the dimensions of these portions after step (b) is performed (Mode A).

Figure 4:
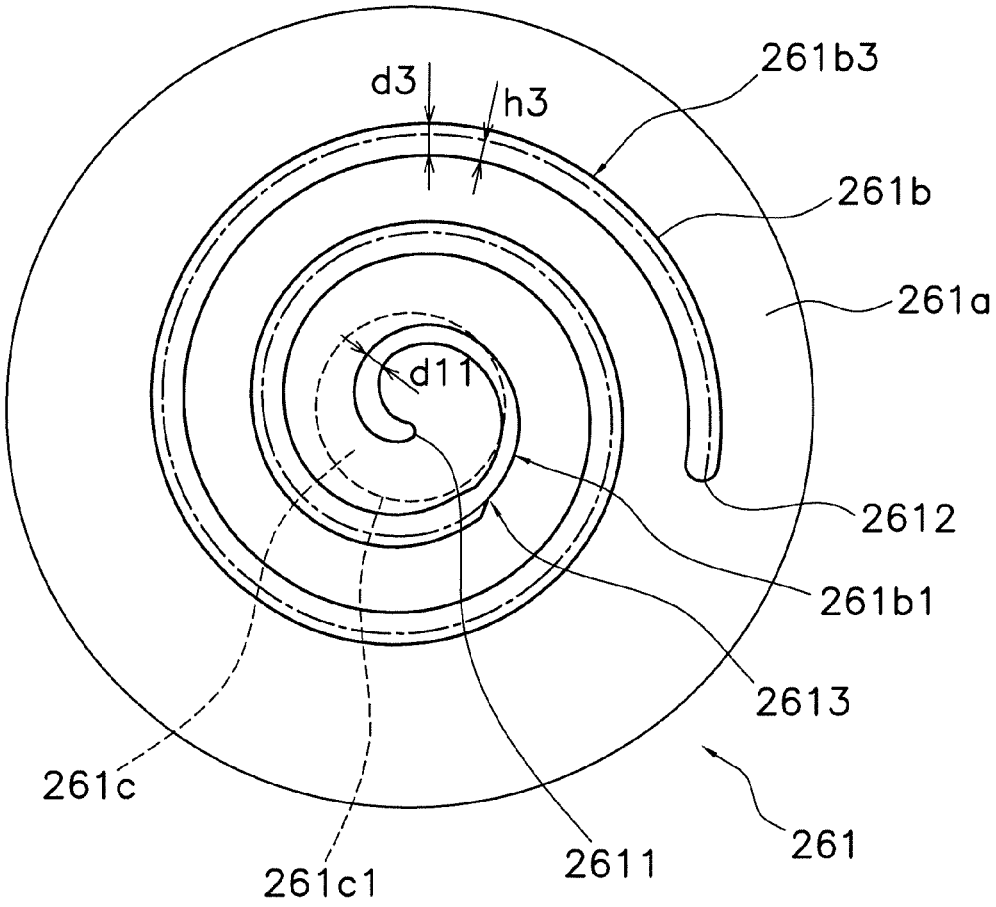
FIG. 4 pertains to an orbiting scroll and schematically depicts an iron casting 261 obtained in step (a).

Specifically, in the spiraling part 261*b* in FIG. 4, the thickness d3 of the portion 261*b*3 is greater than the thickness h1 of the portion 261*b*3 after step (b) is performed. In other words, in the aforementioned Mode A, the portion 261*b*3 is used as a specified portion, and the thickness d3 of the portion 261*b*3 is used as the dimension.

The portion 261*b*3 extends along the spiral from an end 2612 on the external periphery of the spiral up to a position 2613 different from the end 2611 at the center 9 of the spiral.

Figure 5:
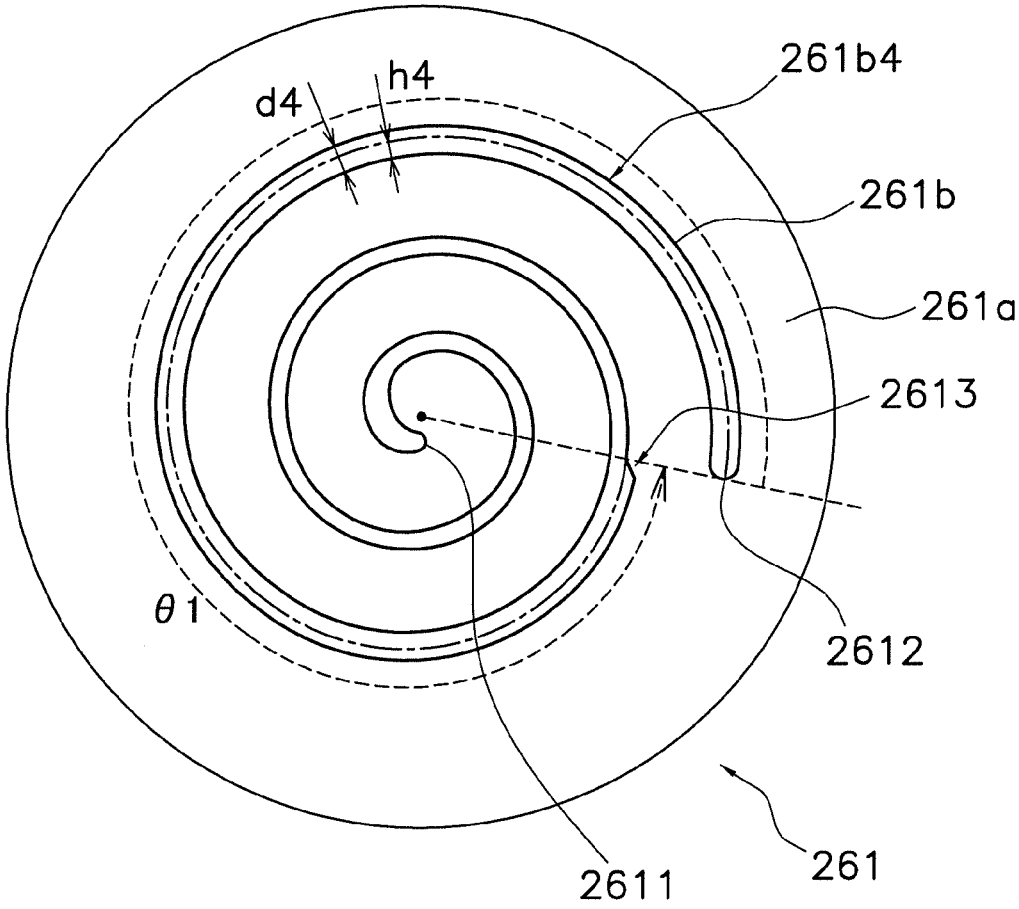
FIG. 5 pertains to an orbiting scroll and schematically depicts an iron casting 261 obtained in step (a).

In the spiraling part 261*b* in FIG. 5, the thickness d4 of a portion 261*b*4 is greater than the thickness h4 of the portion 261*b*4 after step (b) is performed. In other words, in the aforementioned Mode A, the portion 261*b*4 is used as the specified portion, and the thickness d4 of the portion 261*b*4 is used as the dimension.

The portion 261*b*4 extends around the center 9 to a position located anywhere from a half circle (angle θ1=90° up to a full circle (angle θ1=180° from the end 2612. The angle θ1 is an angle formed by the direction in which the spiral extends from the end 2612 and the circumference of the center 9, and FIG. 5 shows a case in which θ1 is 180°.

According to this method for manufacturing an orbiting scroll, the dimensions d3, d4 of the portions 261*b*3, 261*b*4 near the end 2612 on the external periphery of the spiral in step (a) are made to be greater than the dimensions h3, h4 after step (b) is performed, whereby the heat capacity of the portions 261*b*3, 261*b*4 is increased. These portions 261*b*3, 261*b*4 are consequently more resistant to cooling even after being formed. The hardness of the portions 261*b*3, 261*b*4 can thereby be increased, and wear in the orbiting scroll 26 can be reduced.

With the shape of the spiraling part 261*b* shown in FIG. 5 in particular, in the spiraling part 261*b*, the hardness of the portion 261*b*4 positioned on the external periphery of the spiral can be increased.

Returning to FIG. 4, the iron casting 261 also has a protruding part 261*c*. The protruding part 261*c* is fixed to the fixed part 261*a* on the side opposite the spiraling part 261*b* and is positioned near the center 9.

When the iron casting 261 is viewed from the side having the spiraling part 261*b*, the portion 261*b*3 of the spiraling part 261*b* is positioned farther peripherally outward than the side surface 261*c*1 of the protruding part 261*c*.

With this shape of the spiraling part 261*b*, since the protruding part 261*c* is near the center 9, the heat capacity of the portion of the iron casting 261 near the center 9 is greater, and this portion is resistant to cooling even after being formed. Consequently, in the spiraling part 261*b*, the portion 261*b*1 near the center 9 is resistant to cooling, and the hardness of the portion 261*b*1 of the spiraling part 261*b* is also increased. In FIG. 4, the portion 261*b*1 is positioned farther peripherally inward than the side surface 261*c*1 of the protruding part 261*c* when the iron casting 261 is viewed from the side having the spiraling part 261*b*.

Moreover, in the spiraling part 261*b*, it is also possible to increase the hardness of the portion 261*b*2 positioned farther peripherally outward than the side surface 261*c*1 of the protruding part 261*c*. Consequently, the difference between the hardness of the portion 261*b*3 and the hardness of the portion 261*b*1 is smaller, and variations in hardness in the iron casting 261 are smaller as well.

In FIG. 4, the thickness d3 of the portion 261*b*3 of the spiraling part 261*b* is greater than the thickness d11 of the portion 261*b*1 of the spiraling part 261*b*.

With this shape of the spiraling part 261*b*, the difference in hardness between the portion 261*b*3 and the portion 261*b*1 can be further reduced.

Figure 6:
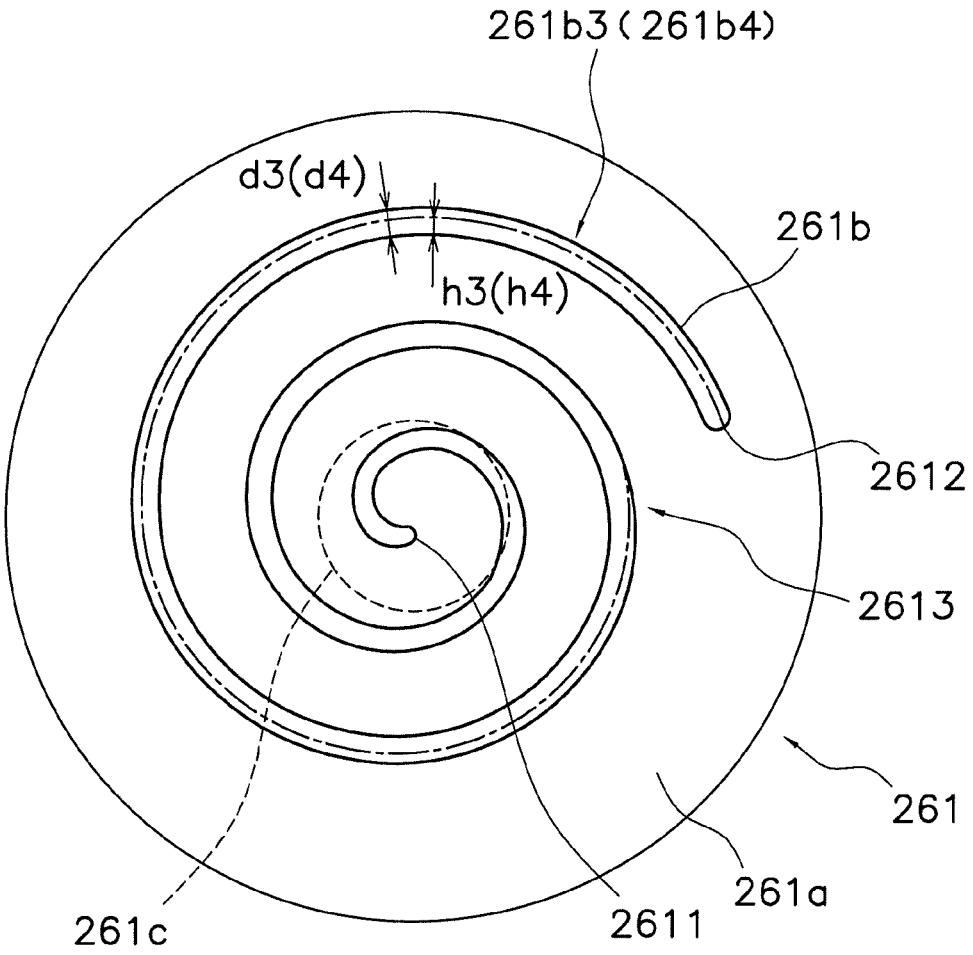
FIG. 6 pertains to an orbiting scroll and schematically depicts an iron casting 261 obtained in step (a).

In FIGS. 4 and 5, both of the portions 261*b*3 and 261*b*4 of the spiraling part 261*b* extend from the end 2611 to the position 2613 at constant thicknesses d3, d4, but the thickness d3 (d4) may also be made to decrease progressively going from the end 2611 toward the position 2613, as shown in FIG. 6, for example. The specifics of this can be understood in terms of the thickness d3 (d4) of the spiraling part 261*b* decreasing progressively from the end 2612 near the external periphery toward the end 2611 near the center 9.

As described above, in cases in which the iron casting 261 has a protruding part 261C, the portion near the center 9 of the iron casting 261 has greater heat capacity and is more resistant to cooling. Consequently, the portion 261*b*3 (261*b*4) in the external periphery of the spiraling part 261*b*, becomes more resistant to cooling and increases more readily in hardness in portions nearer to the center 9. Therefore, in the portion 261*b*3 (261*b*4) of the spiraling part 261*b*, variations in hardness are likely to occur.

With this shape of the spiraling part 261*b* shown in FIG. 6, the nearer to the end 2612 at the external periphery, a greater thickness d3 (d4) of the portion 261*b*3 (261*b*4) corresponds to a greater possible increase in hardness in portions near the end 2612. Consequently, variations in hardness in the portion 261*b*3 (261*b*4) can be reduced.

In the portions 261*b*3, 261*b*4 of the spiraling part 261*b* in all of the iron castings 261 shown in FIGS. 4 through 6, the portions in the external peripheries are cut in step (b) up to the positions of the single-dashed lines.

Since the portions 261*b*3, 261*b*4 of the spiraling part 261*b* are positioned in the external periphery of the spiral, the portions 261*b*3, 261*b*4 are easily cut in the external peripheral portions.

Figure 7:
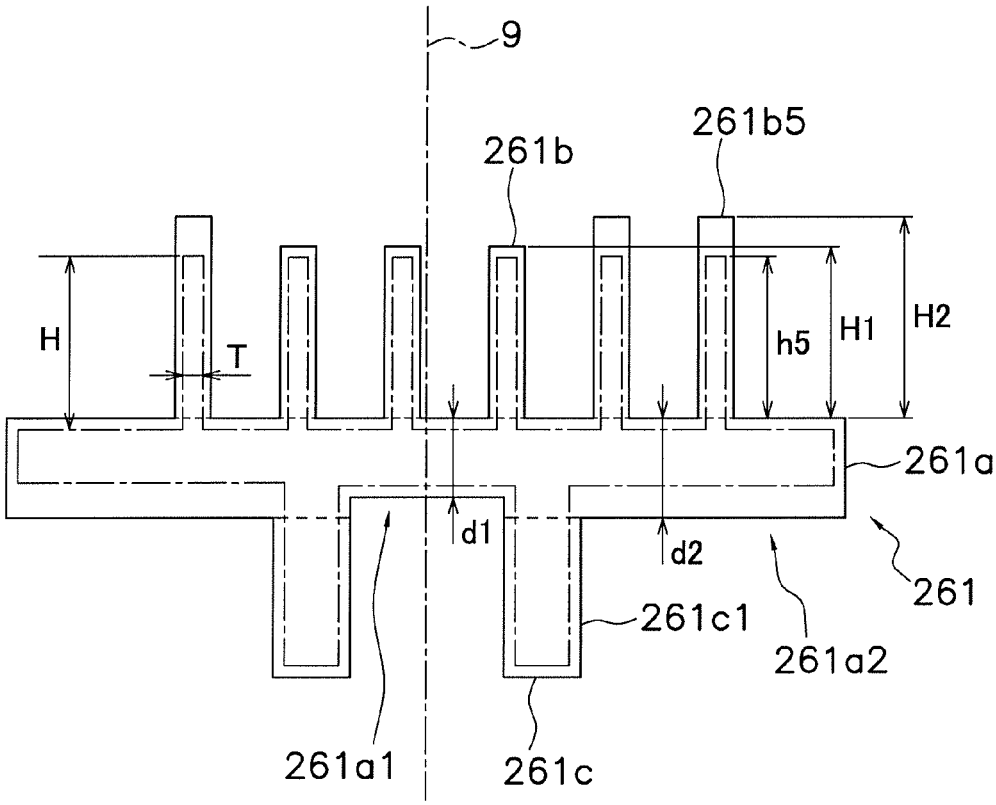
FIG. 7 pertains to an orbiting scroll and schematically depicts an iron casting 261 obtained in step (a).

In FIG. 7, in a portion 261*b*5 on the external periphery of the side surface 261*c*1 of the protruding part 261*c* in the spiraling part 261*b*, the height H2 from the fixed part 261*a* is greater than the height h5 of the portion 261*b*5 after step (b) is performed. In other words, in Mode A, the portion 261*b*5 of the spiraling part 261*b* is used as the specified portion, and the height H2 of the portion 261*b*5 is used as the dimension.

With this shape of the spiraling part 261*b*, in the portion 261*b*5 of the spiraling part 261*b*, it is possible to increase the hardness of the portion located at the distal end when the portion is viewed from the fixed part 261*a*.

In the spiraling part 261*b*, the height H2 of the portion 261*b*5 is made to be greater than the height H1 of the portion 261*b*1 father peripherally inward than the side surface 261*c*1 of the protruding part 261*c*, for the sake of reducing variations in hardness in the spiraling part 261*b*.

In the present embodiment, the thicknesses d3, d4 (FIGS. 4 through 6) and height H2 (FIG. 7) of the spiraling part 261*b* may both be respectively greater than the thicknesses h3, h4 and height h5 after step (b) is performed.

It shall be apparent that the thicknesses d3, d4 alone of the spiraling part 261*b* may be made to be greater than the thicknesses h3, h4 after step (b) is performed as shown in FIGS. 4 through 6, and the height H2 alone of the spiraling part 261*b* may be made to be greater than the height h5 after step (b) is performed as shown in FIG. 7.

Third Embodiment

The method for manufacturing the fixed scroll 24, which is a scroll member, comprises a step (a) and a step (b), similar to the second embodiment.

Figure 8:
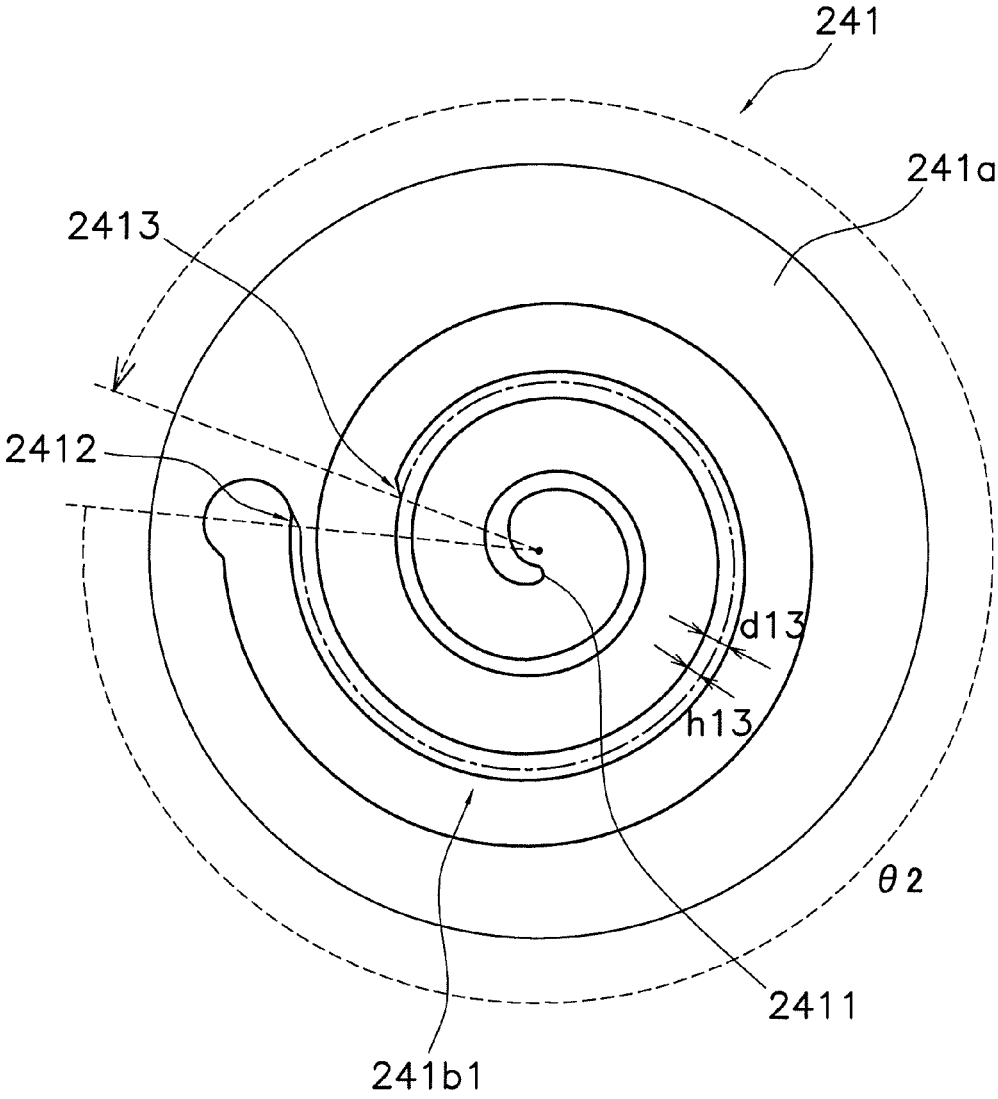
FIG. 8 pertains to a fixed scroll and schematically depicts an iron casting 241 obtained in step (a).

FIG. 8 schematically depicts an iron casting 241 obtained in step (a) in the manufacturing of a fixed scroll 24. The iron casting 241 has a fixed part 241*a* and a spiraling part 241*b*. The spiraling part 241*b* is fixed to the fixed part 241*a* and is made to extend in a spiraling formation. In FIG. 8, the shape of the spiraling part 241*b* obtained by performing step (b); i.e., the shape of the fixed scroll 24 is shown by the single-dashed line. In the iron casting 241 obtained in step (a), the dimension of the specified portion of the spiraling part 241*b* is greater than the dimension of the same portion after step (b) is performed (Mode B), similar to the iron casting 261 shown in FIGS. 4 and 5.

Specifically, in FIG. 8, the thickness d13 of the portion 241*b*1 of the spiraling part 241*b* is greater than the thickness h13 of the portion 241*b*1 after step (b) is performed. In other words, in the aforementioned Mode B, the portion 241*b*1 is used as the specified portion, and the thickness d13 of the portion 241*b*1 is used as the dimension.

The portion 241*b*1 extends along the spiral from the end 2412 at the external periphery of the spiral up to a position 2413 that is different from the end 2411 at the center 9 of the spiral.

In FIG. 8, the portion 241*b*1 extends around the center 9 to a position located anywhere from a half circle (angle θ2=90° up to a full circle (angle θ2=180° from the end 2412. The angle θ2 is an angle formed by the direction in which the spiral extends from the end 2412 and the circumference of the center 9, and FIG. 8 shows a case in which θ1 is between 90° and 180°.

By performing step (b) on the iron casting 241 obtained in step (a), a panel 24*a* is obtained from the fixed part 241*a*, and a compression member 24*b* is obtained from the spiraling part 241*b*.

According to this method for manufacturing a fixed scroll 24, the heat capacity of the portion 241*b*1 of the spiraling part 241*b* can be increased, and the hardness of this same portion 241*b*1 can be increased, similar to the method for manufacturing an orbiting scroll 26 described in the first embodiment. Consequently, wear in the fixed scroll 24 can be reduced.

With this shape of the spiraling part 241*b* shown in FIG. 8 in particular, it is possible to increase the hardness of the portion 241*b*1 positioned in the external periphery of the spiral in the spiraling part 241*b*.

In the method for manufacturing a fixed scroll 24, the shape shown in FIG. 6 or 7 may be used for the spiraling part 241*b*.

Fourth Embodiment

The following is a description of the orbiting scroll 26 obtained by either one of the manufacturing methods in the first and second embodiments.

As described in the first and second embodiments, the compression member 26*b* belonging to the orbiting scroll 26 obtained by the pertinent manufacturing methods; i.e., the spiraling part 261*b* after step (b) is performed, has a high hardness.

Consequently, in the portion near the external periphery in the compression member 26*b*, the compression member 26*b* does not readily deform even if the ratio H/T of the height H of the compression member 26*b* from the panel 26*a* (FIGS. 2, 3, and 7) to the thickness T of the compression member 26*b* (FIGS. 2, 3, and 7) is 8.5 or greater. The orbiting scroll 26 can be reduced in size by designing the orbiting scroll 26 with this ratio H/T.

The orbiting scroll 26 manufactured by the method according to the first and second embodiments resists wear and deformation. Consequently, break-downs with the compression mechanism 15 can be minimized by using the orbiting scroll 26 as a scroll member of the compression mechanism 15.

A compression member 24*b* having high strength is also obtained with the fixed scroll 24 obtained by the manufacturing method of the third embodiment. Consequently, the ratio H/T of the height H of the compression member 24*b* to the thickness T can be made to be 8.5 or greater.

The fixed scroll 24 resists wear and deformation. Consequently, break-downs with the compression mechanism 15 can be minimized by using the fixed scroll 24 as a scroll member of the compression mechanism 15.

EXAMPLES

Structure of Scroll Compressor

The structure of the scroll compressor 1 will be described in greater detail using FIG. 1. In addition to the case 11 and the compression mechanism 15, the scroll compressor 1 comprises an Oldham ring 2, a fixed member 12, a motor 16, a crankshaft 17, an intake pipe 19, a discharge pipe 20, and a bearing 60.

The case 11 has a cylindrical shape and extends along the direction 91. The Oldham ring 2, the fixed member 12, the motor 16, the crankshaft 17, and the bearing 60 are housed within the case 11.

The motor 16 has a fixed element 51 and a rotary element 52. The fixed element 51 is annular in shape and is fixed to an internal wall 11*a* of the case 11. The rotary element 52 is provided to the internal periphery of the fixed element 51 and is made to face the fixed element 51 across an air gap.

The crankshaft 17 extends along the direction 91 and has a main shaft 17*a* and an eccentric part 17*b*. The main shaft 17*a* is a portion that rotates around a rotational axis 90 and is connected to the rotary element 52. The eccentric part 17*b* is a portion disposed unevenly with respect to the rotational axis 90, and is connected to the top side of the main shaft 17*a*. The lower end of the crankshaft 17 is slidably supported by the bearing 60.

The fixed member 12 is specifically a housing in FIG. 1, and is fitted without any gaps into the internal wall 11*a* of the case 11. The fixed member 12 is fitted into the internal wall 11*a* by, e.g., press fitting, shrink fitting, or another method. The fixed member 12 may be fitted into the internal wall 11*a* via a seal.

Since the fixed member 12 is fitted into the internal wall 11*a* without gaps, a space 28 positioned on the underside of the fixed member 12 and a space 29 positioned on the top side are partitioned without any gaps. Consequently, the fixed member 12 is capable of maintaining pressure differences that occur between the space 28 and the space 29. The pressure in the space 28 is high, and the pressure in the space 29 is low.

A hollow 31 opened in the top side of the fixed member 12 is provided in the vicinity of the rotational axis 90. The eccentric part 17*b* of the crankshaft 17 is accommodated within the hollow 31. Furthermore, the fixed member 12 has a bearing 32 and a hole 33. The bearing 32 supports the main shaft 17*a* while the main shaft 17*a* of the crankshaft 17 is in a state of being inserted through the hole 33.

The surface on the top side of the fixed scroll 24 has a concavity. A space 45 enclosed by a portion 42 in this surface having the concavity is shut by a lid 44. The lid 44 partitions two spaces of different pressures; i.e., the space 45 and the space 29 on the top side.

The orbiting scroll 26 also comprises a bearing 26*c*. The bearing 26*c* is linked to the underside of the panel 26*a*, and the bearing 26*c* slidably supports the eccentric part 17*b* of the crankshaft 17.

<Flow of Refrigerant>

The flow of refrigerant through the scroll compressor 1 will be described using FIG. 1. In FIG. 1, the flow of refrigerant is depicted by arrows. Refrigerant is taken in through the intake pipe 19 and is led into the compression chamber (space 40) of the compression mechanism 15. The refrigerant compressed by the compression chamber (space 40) is discharged out to the space 45 through a discharge hole 41 provided near the center of the fixed scroll 24. Consequently, the pressure in the space 45 is high. Conversely, the pressure in the space 29 partitioned from the space 45 by the lid 44 remains low.

The refrigerant in the space 45 flows sequentially through a hole 46 provided in the fixed scroll 24 and a hole 48 provided in the fixed member 12, and then flows into the space 28 below the fixed member 12. The refrigerant in the space 28 is led into a gap 55 by a guiding plate 58. The gap 55 is provided between the case 11 and part of the side surface of the fixed element 51.

The refrigerant that has flowed through the gap 55 to the space below the motor 16 then flows through an air gap or a space 56 in the motor 16, and then flows into the discharge pipe 20. The space 56 is provided between the case 11 and another part of the side surface of the fixed element 51.

INDUSTRIAL APPLICABILITY

The present invention can be widely applied to the field of scroll members, manufacturing methods thereof, compression mechanisms, and scroll compressors.

What is claimed is:

1. A method of manufacturing a scroll member for a compression mechanism installed in a scroll compressor, the method comprising a casting step including forming an iron casting including a fixed part, a spiraling part extending axially from a side of the fixed part in a spiraling formation, and a protruding part fixed to the fixed part on a side opposite to the side with the spiraling part extending therefrom, with the protruding part having an annular shape encircling a center of the spiraling part; and a cutting step including cutting the iron casting obtained in the casting step along the spiraling formation in order to obtain a final shape of the scroll member, the fixed part of the iron casting obtained in the casting step including a central portion with a first axial thickness and an external periphery portion with a second axial thickness larger than the first axial thickness, the central portion being radially closer to the center of the spiraling part than the external periphery portion, and the external periphery portion being positioned externally of the protruding part when the iron casting is viewed axially, a dimension of a specified portion along a thickness direction of the spiraling part being larger before the cutting step is performed than after the cutting step is performed, the thickness direction being transverse to a direction of the spiraling formation and an axial direction, the specified portion of the spiraling part extending along the spiraling formation from an end on an external periphery of the spiraling part to a position different from an end at the center of the spiraling part, the center of the spiraling part being a circumferential center of the scroll member as viewed along the axial direction, the end at the center of the spiraling part having a same dimension along the thickness direction before and after the cutting step, and the dimension of the specified portion along the thickness direction before the cutting step being larger than the dimension of the end at the center of the spiraling part along the thickness direction before the cutting step, wherein the dimension of the specified portion and the dimension of the end at the center being measured at a same height of the spiraling part along the axial direction.

2. A method of manufacturing a scroll member for a compression mechanism installed in a scroll compressor, the method comprising:

a casting step including forming an iron casting including a spiraling part extending in a spiraling formation; and a cutting step including cutting the iron casting obtained in the casting step along the spiraling formation in order to obtain a final shape of the scroll member, a dimension of a specified portion along a thickness direction of the spiraling part being larger before the cutting step is performed than after the cutting step is performed, the thickness direction being transverse to a direction of the spiraling formation and an axial direction, the specified portion of the spiraling part extending along the spiraling formation from an end on an external periphery to a position different from an end at a center of the spiraling part, the center of the spiraling part being a circumferential center of the scroll member as viewed along the axial direction, the end at the center of the spiraling part having a same dimension along the thickness direction before and after the cutting step, and the dimension of the specified portion along the thickness direction before the cutting step being larger than the dimension of the end at the center of the spiraling part along the thickness direction before the cutting step, wherein the dimension of the specified portion and the dimension of the end at the center being measured at a same height of the spiraling part along the axial direction.

3. The method of manufacturing a scroll member according to claim 2, wherein the iron casting obtained in the casting step further includes a fixed part with the spiraling part extending axially from a side of the fixed part, and a protruding part fixed to the fixed part on a side opposite to the side with the spiraling part extending therefrom, with the protruding part positioned closer to the center of the spiraling part than the end of the spiraling portion on the external periphery, wherein the specified portion is positioned peripherally outward of a side surface of the protruding part when the iron casting is viewed axially.

4. The method of manufacturing a scroll member according to claim 3, wherein the dimension of the specified portion is greater than a dimension of a portion of the spiraling part located peripherally inward of the side surface before the cutting step.

5. The method of manufacturing a scroll member according to claim 2 wherein the specified portion extends from 180 degrees to 360 degrees from the end of the spiraling portion on the external periphery.

6. The method of manufacturing a scroll member according to claim 5, wherein the specified portion is cut in the cutting step only on the external periphery.

7. The method of manufacturing a scroll member according to claim 2, wherein the iron casting obtained in the casting step further includes a fixed part with the spiraling part extending therefrom; and a height of the specified portion measured from the fixed part is larger before the cutting step is performed than after the cutting step is performed.

8. The method of manufacturing a scroll member according to claim 2, wherein the iron casting obtained in the casting step further includes a fixed part with the spiraling part extending therefrom; and the dimension is a height of the specified portion of the spiraling part measured from the fixed part.

9. The method of manufacturing a scroll member according to claim 2, wherein the dimension of the specified portion decreases progressively from the end on the external periphery toward the at the center of the spiraling part before the cutting step.

10. The method of manufacturing a scroll member according to claim 1, wherein the iron casting is formed by semi-molten die casting in the casting step.

11. The method of manufacturing a scroll member according to claim 2, wherein the iron casting is formed by semi-molten die casting in the casting step.

12. The method of manufacturing a scroll member according to claim 1, wherein the cutting step further includes cutting, in a first direction, more from an outer portion of the fixed part disposed outward of the protruding part than from an inner portion of the fixed part disposed inward of the protruding part with respect to the center of the spiraling part.

* * * * *